US008888320B2

(12) United States Patent
Lueken et al.

(10) Patent No.: US 8,888,320 B2
(45) Date of Patent: Nov. 18, 2014

(54) PRISMATIC LED MODULE FOR LUMINAIRE

(71) Applicant: Hubbell Incorporated, Shelton, CT (US)

(72) Inventors: Thomas Carl Lueken, Diamond Bar, CA (US); Michael Scott Neuer, Covina, CA (US); Zhijie Chen, Simpsonville, SC (US); Jamey Butteris, Simpsonville, SC (US); Ezekial Thomas Hill, Spartanburg, SC (US)

(73) Assignee: Hubbell Incorporated, Shelton, CT (US)

( * ) Notice: Subject to any disclaimer, the term of this patent is extended or adjusted under 35 U.S.C. 154(b) by 131 days.

(21) Appl. No.: 13/747,033

(22) Filed: Jan. 22, 2013

(65) Prior Publication Data

US 2013/0208471 A1 Aug. 15, 2013

Related U.S. Application Data

(60) Provisional application No. 61/591,619, filed on Jan. 27, 2012.

(51) Int. Cl.
*F21V 5/02* (2006.01)
*F21V 29/00* (2006.01)

(52) U.S. Cl.
CPC ..... *F21V 5/02* (2013.01); *F21V 29/2206* (2013.01)
USPC ..... 362/235; 362/294; 362/329

(58) Field of Classification Search
CPC ..... F21V 29/2206; F21V 5/02
USPC ..... 362/235, 294, 329
See application file for complete search history.

(56) References Cited

U.S. PATENT DOCUMENTS

| | | | |
|---|---|---|---|
| 2,215,900 | A | 9/1940 | Bitner |
| 2,356,654 | A | 8/1944 | Cullman |
| 3,646,338 | A | 2/1972 | Goytisolo |
| 4,420,800 | A | 12/1983 | Van Horn |
| 4,849,866 | A | 7/1989 | Mori |

(Continued)

FOREIGN PATENT DOCUMENTS

JP 11-297106 A 10/1999

OTHER PUBLICATIONS

Kim Lighting, Altitude Catalog Description, 2012.
Kim Lighting, WARP9 LED Catalog Description, 2009.

(Continued)

*Primary Examiner* — Stephen F Husar
*Assistant Examiner* — James Cranson, Jr.
(74) *Attorney, Agent, or Firm* — Kevin M. Barner; Mark S. Bicks; Alfred N. Goodman

(57) ABSTRACT

An LED module for a luminaire has a downwardly directed heat sink comprising cooling fins that extend rearward from the module's front end and downward from its top wall, which has a top face that abuts the underside of a luminaire carrier plate. A circuit board carrying at least one LED is mounted on the front face, and a prism is mounted to the heat sink over the LED(s). The front (light-emitting) face of the catadioptric prism has several prominent side-by-side sections which emit beam patterns that diverge laterally and overlap in a central region. A prominent full-width upper section on the front face emits a primarily downwardly directed beam pattern to help fill in dark spots.

25 Claims, 9 Drawing Sheets

(56) References Cited

U.S. PATENT DOCUMENTS

| | | | | |
|---|---|---|---|---|
| 5,083,245 | A | 1/1992 | Fray | |
| 5,580,156 | A | 12/1996 | Suzuki et al. | |
| 5,813,743 | A | 9/1998 | Naka | |
| 6,250,774 | B1 | 6/2001 | Begemann et al. | |
| 6,414,801 | B1 | 7/2002 | Roller | |
| 6,416,237 | B2 | 7/2002 | Lissotschenko et al. | |
| 6,547,423 | B2 | 4/2003 | Marshall et al. | |
| 6,550,941 | B1 | 4/2003 | Keuper et al. | |
| 6,575,582 | B2 | 6/2003 | Tenmyo | |
| 6,598,998 | B2 | 7/2003 | West | |
| 6,641,284 | B2 | 11/2003 | Stopa et al. | |
| 6,811,287 | B2 * | 11/2004 | Roller et al. | 362/336 |
| 6,936,855 | B1 | 8/2005 | Harrah | |
| 7,029,150 | B2 | 4/2006 | Finch | |
| D549,186 | S | 8/2007 | Yuzawa | |
| 7,287,879 | B2 | 10/2007 | Hsu | |
| 7,325,955 | B2 | 2/2008 | Lucas et al. | |
| 7,365,370 | B2 | 4/2008 | Hung | |
| 7,401,948 | B2 | 7/2008 | Chinniah et al. | |
| D577,852 | S | 9/2008 | Miyairi et al. | |
| 7,422,347 | B2 | 9/2008 | Miyairi | |
| 7,461,960 | B2 | 12/2008 | Opolka | |
| 7,540,635 | B2 | 6/2009 | Kim | |
| 7,618,160 | B2 | 11/2009 | Chinniah et al. | |
| 7,686,486 | B2 | 3/2010 | Tessnow et al. | |
| 7,695,161 | B2 | 4/2010 | Zhang | |
| 7,712,925 | B2 * | 5/2010 | Russell | 362/294 |
| D617,937 | S | 6/2010 | Farmer et al. | |
| D619,752 | S | 7/2010 | Zhang | |
| D622,898 | S | 8/2010 | Chen et al. | |
| D622,899 | S | 8/2010 | Chen et al. | |
| 7,766,509 | B1 * | 8/2010 | Laporte | 362/249.02 |
| D625,881 | S | 10/2010 | Chen et al. | |
| 7,837,359 | B2 | 11/2010 | Danek | |
| D629,560 | S | 12/2010 | Shimokawa | |
| 7,918,590 | B1 | 4/2011 | Li | |
| 7,959,326 | B2 | 6/2011 | Laporte | |
| 7,972,035 | B2 | 7/2011 | Boyer | |
| 7,985,009 | B2 | 7/2011 | Ho | |
| 7,993,036 | B2 | 8/2011 | Holder | |
| 8,007,140 | B2 | 8/2011 | Zhang | |
| 8,342,709 | B2 | 1/2013 | Lueken | |
| 2002/0008976 | A1 | 1/2002 | Gronemeier | |
| 2004/0202007 | A1 | 10/2004 | Yagi | |
| 2006/0146531 | A1 | 7/2006 | Reo | |
| 2008/0080162 | A1 | 4/2008 | Wilcox | |
| 2010/0128233 | A1 | 5/2010 | Liu et al. | |
| 2010/0177262 | A1 | 7/2010 | Kimura | |
| 2010/0195333 | A1 | 8/2010 | Schaefer et al. | |
| 2010/0219758 | A1 * | 9/2010 | Melzner et al. | 315/113 |
| 2010/0238666 | A1 | 9/2010 | Ominato | |
| 2010/0302783 | A1 | 12/2010 | Shastry | |
| 2011/0110081 | A1 * | 5/2011 | Belknap et al. | 362/235 |
| 2011/0204242 | A1 | 8/2011 | Hoch et al. | |
| 2011/0280044 | A1 | 11/2011 | Niioka | |

OTHER PUBLICATIONS

Acuity Brands Lighting, Holophane, LEDGEND Roadway LED Luminaire Catalog Description, 2010.

* cited by examiner

PRISMATIC LED MODULE FOR LUMINAIRE

CROSS REFERENCE TO RELATED APPLICATIONS

This application claims the benefit of U.S. provisional patent application No. 61/591,619, filed Jan. 27, 2012, which is incorporated by reference herein in its entirety.

FIELD OF THE INVENTION

The invention relates to the field of lighting and concerns luminaires utilizing light emitting diodes (LEDs) for illuminating an area. More particularly, the invention concerns LED modules that can be arrayed in a luminaire to provide a desired level, direction and pattern of illumination.

BACKGROUND

Commonly owned U.S. Pat. No. 8,342,709, which is incorporated by reference herein in its entirety, discloses various arrays of LED modules that snap into relatively large rectangular openings in a luminaire carrier plate. A portion of each module's heat sink extends into the luminaire housing above the carrier plate, and each module has a four-sided reflector that shapes and directs the light emitted by a row of LEDs mounted on a circuit board.

SUMMARY OF THE INVENTION

The LED module of the present invention has a downwardly directed heat sink and is adapted for installation on the underside of a luminaire carrier plate. The heat sink comprises a front end having a front face, a top wall extending rearward from the front end, and a plurality of cooling fins extending rearward from the front end and downward from the top wall. The top wall has a top face for abutting the underside of the luminaire carrier plate. A circuit board carrying at least one LED is mounted on the front face, and a prism is mounted to the heat sink over the LED(s). The top face preferably is disposed at an acute angle to the front face, and the cooling fins preferably taper in height from the front end rearward.

Another aspect of the invention is a catadioptric prism per se for shaping and directing light emitted by an even number of aligned, laterally spaced LEDs. The prism has a transparent body with a fore-and-aft medial vertical plane and comprises a rear light-receiving face, a front light-emitting face, a top face, a bottom face and two side faces. The front face has several prominent sections, as follows. A lower section on each side of the medial vertical plane has a substantially vertical front, and substantially vertical curved sides that merge with the front. A middle section on each side of the medial vertical plane and above the lower section is wider than it is high and has a substantially horizontal rounded face with rounded ends that merge with the rounded face. An upper section, which is above both middle sections, has a downwardly and forwardly slanted surface. The rear face of the prism has a convex cradle section on each side of the medial vertical plane. Each cradle section has at least one pocket behind the middle section of the front face for cradling an LED; and the pockets are symmetrically disposed on opposite sides of the medial vertical plane. The prism preferably is bilaterally symmetrical about the medial vertical plane.

BRIEF DESCRIPTION OF THE DRAWING

Preferred embodiments of the disclosed invention, including the best mode for carrying out the invention, are described in detail below, purely by way of example, with reference to the accompanying drawing figures, in which.

DETAILED DESCRIPTION OF THE INVENTION

Figure 1:
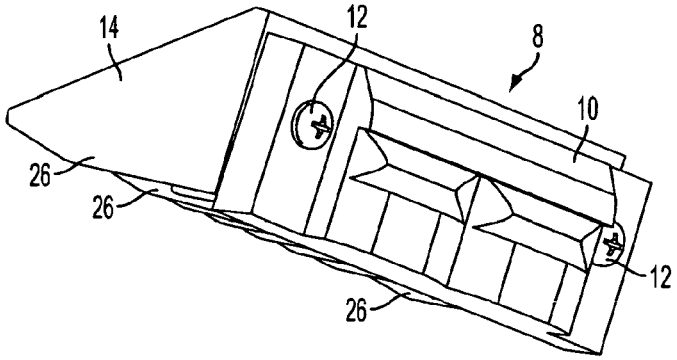
FIG. 1 is a perspective view of an LED module according to the invention, taken from the front and left side thereof.
Figure 2:
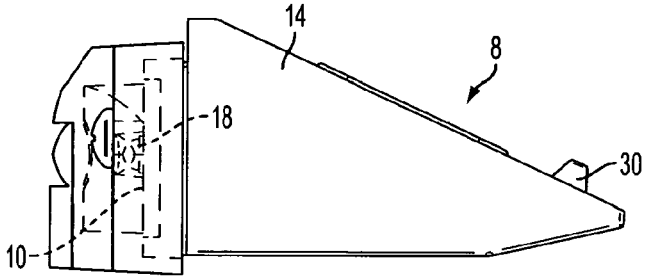
FIG. 2 is a side elevational view thereof.
Figure 3:
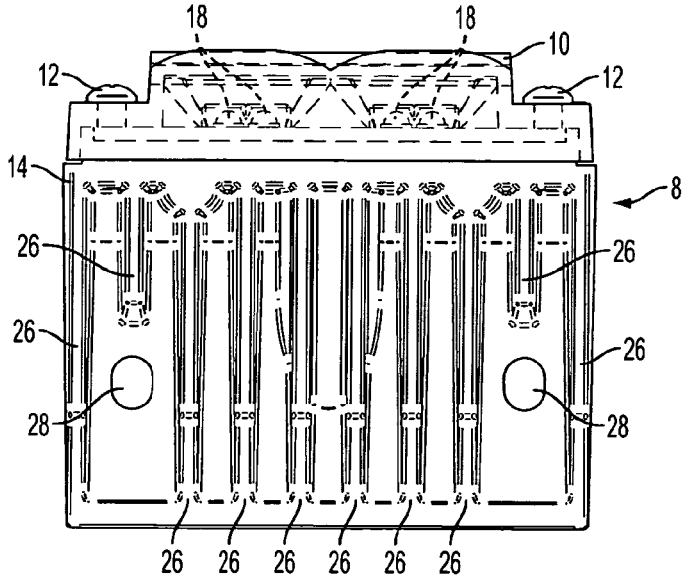
FIG. 3 is a bottom plan view thereof.
Figure 4:
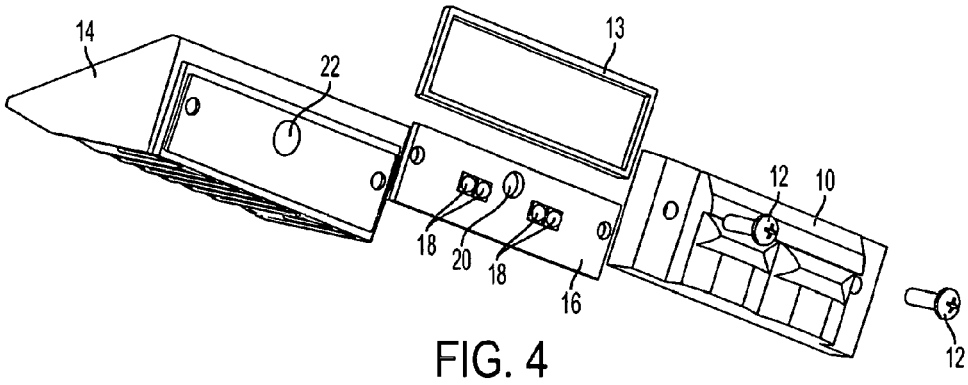
FIG. 4 is an exploded view thereof.
Figure 5:
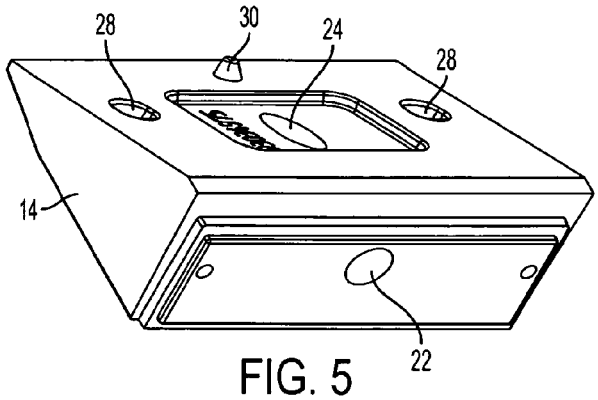
FIG. 5 is a perspective view of the heat sink portion of the module of FIG. 1 taken from the front, top and left side.
Figure 6:
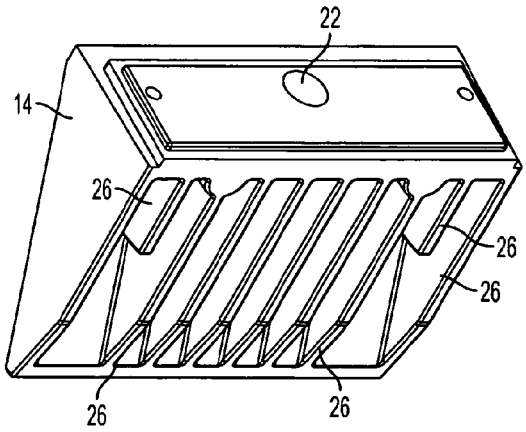
FIG. 6 is a perspective view thereof taken from the front, bottom and left side.

As used in this application, including the claims, terms such as "front," "rear," "side," "top," "bottom," "above," "below," "upward," "downward," "lateral," "vertical" and "horizontal" are used in a relative sense to facilitate the description of the invention, and are not intended to limit the invention to any particular position or orientation except when clearly describing its orientation in an installed, operational position.

Referring to FIGS. 1-6, an exemplary sealed LED module 8 according to the invention comprises an optically clear prism 10 secured by two screws 12 to the front of a wedge-shaped heat sink 14 over a printed circuit board (PCB) 16, which carries four aligned, laterally spaced LEDs 18 symmetrically arranged in two pairs. A thermal paste or other conventional heat transfer medium preferably is interposed between PCB 16 and the front face of heat sink 14. A rectangular gasket 13 is disposed between prism 10 and heat sink 14 to surround and seal PCB 16 from the environment. A hole 20 in PCB 16 and holes 22, 24 in heat sink 14 enable routing of power conductors (not shown) through the heat sink to the PCB.

Heat sink 14 preferably is made of anodized, die cast aluminum and has a series of parallel vertical cooling fins 26 on its underside. The penultimate cooling fin on each side is shortened to make room for a mounting hole 28 in the top wall 29 of the heat sink, which accommodates a mounting screw (not shown) from below for attachment to the carrier plate P of a luminaire (see, e.g., FIGS. 7 and 8). A locating stud 30, which projects upward from the top wall 29, is adapted to register with a mating feature on the carrier plate to ensure proper positioning of the module 8 against the underside of the carrier plate. A rectangular central upper gasket (not shown) forms a seal against the carrier plate around hole 24.

Figure 7:
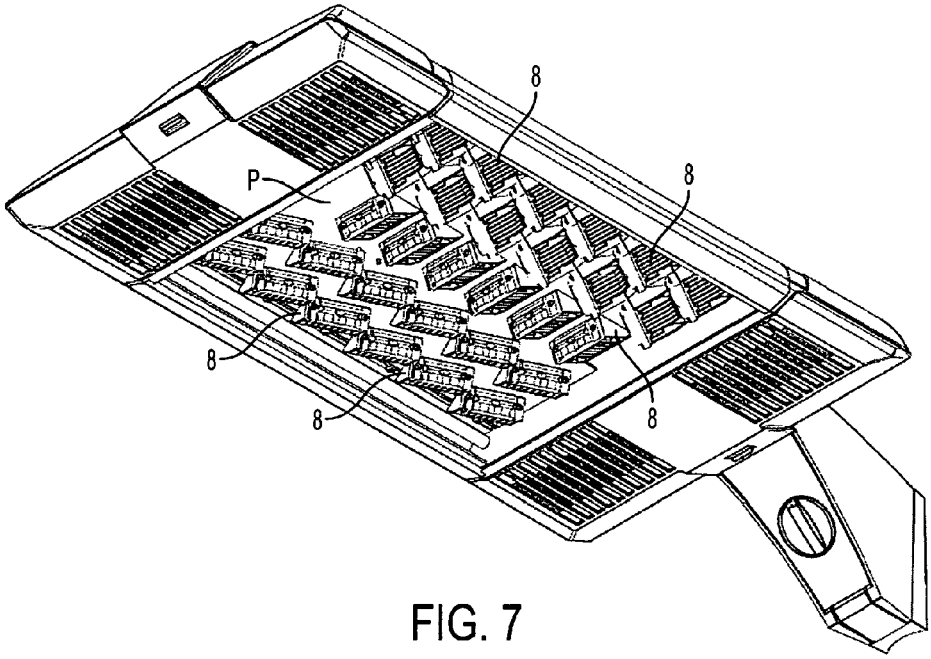
FIG. 7 is a bottom perspective view of a luminaire having a particular array of LED modules according to FIGS. 1-4 installed therein.
Figure 8:
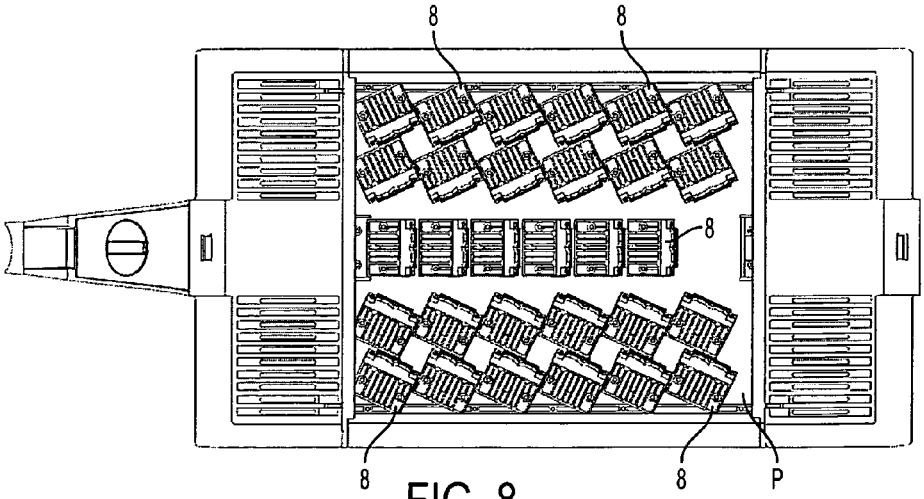
FIG. 8 is a bottom plan view thereof.
Figure 9:
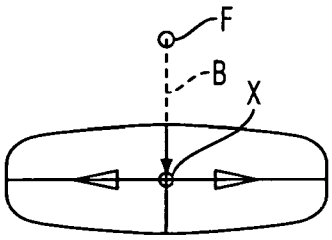
FIGS. 9 through 13 are schematic illustrations of five different light beam patterns producible by five different arrays of LED modules according to the invention.
Figure 10:
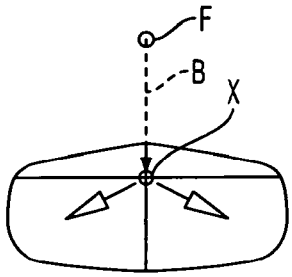
Figure 11:
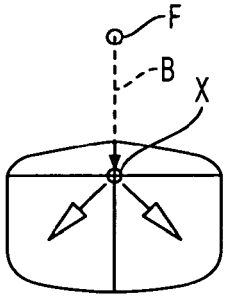
Figure 12:
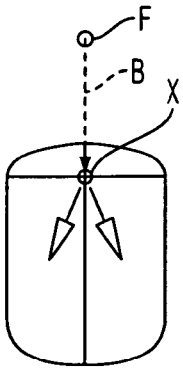
Figure 13:
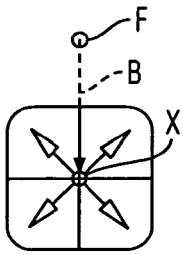
Figure 15:
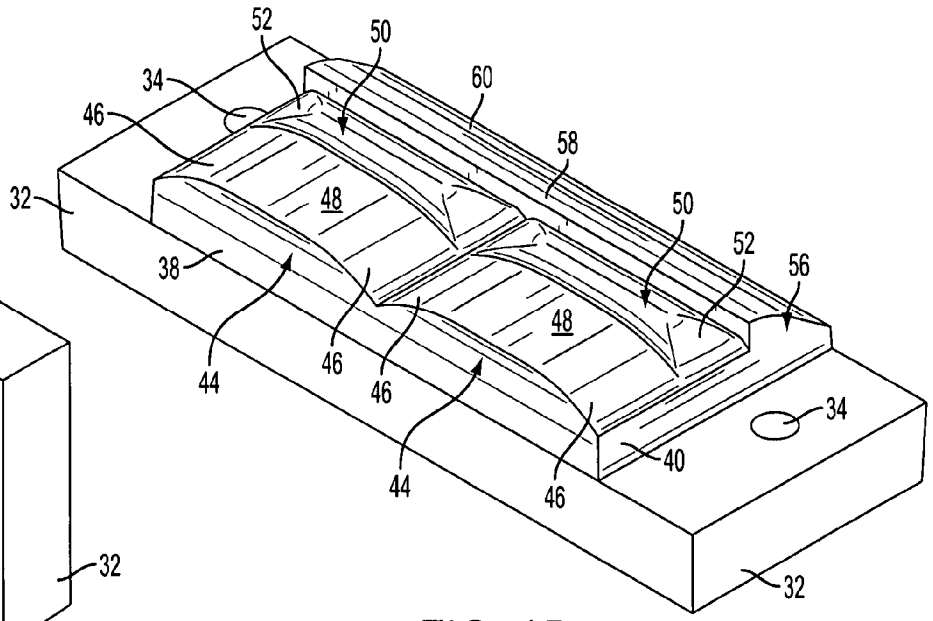
FIG. 15 is a perspective view thereof taken from the front, bottom and right side.
Figure 14:
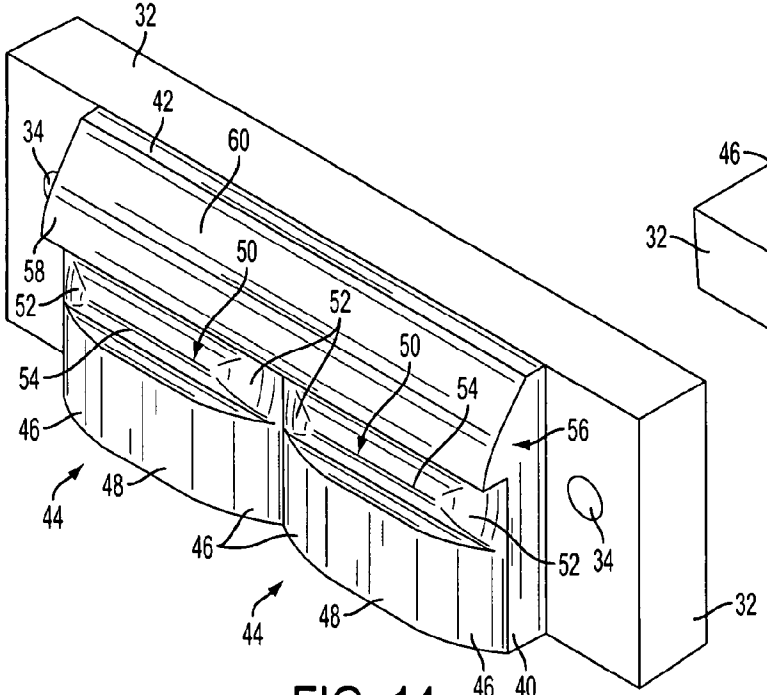
FIG. 14 is a perspective view of a prism of the invention taken from the front, top and right side thereof.
Figure 17:
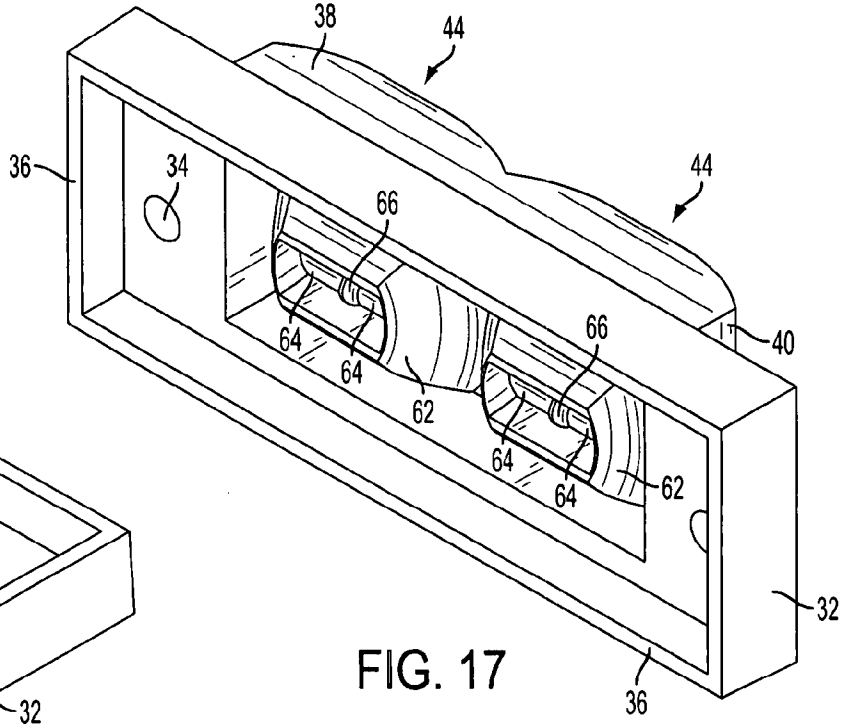
FIG. 17 is a perspective view thereof taken from the rear, bottom and right side.
Figure 16:
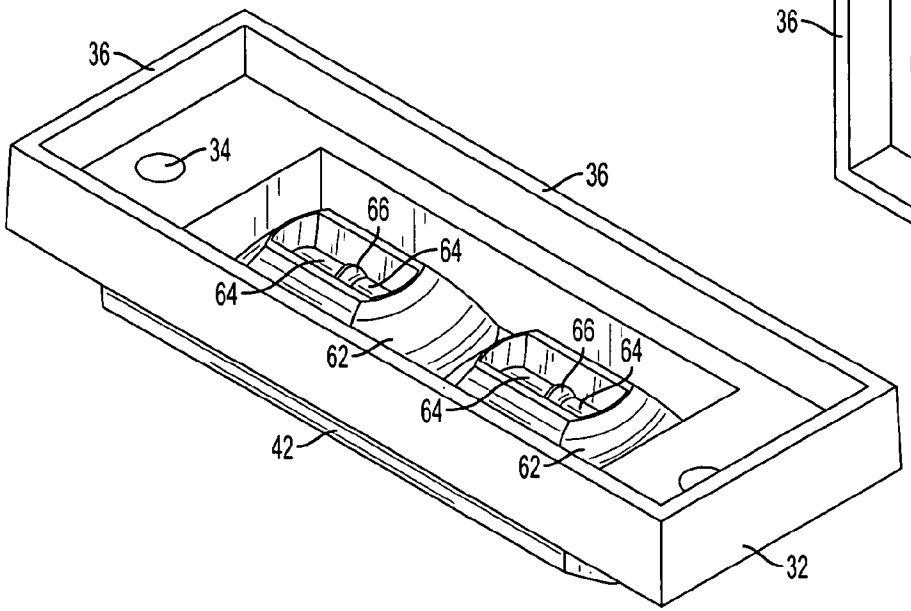
FIG. 16 is a perspective view thereof taken from the rear, top and right side.
Figure 18:
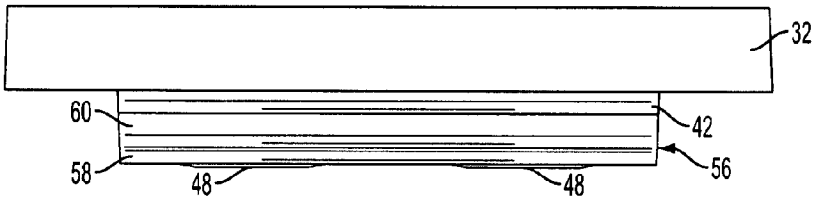
FIG. 18 is a top plan view thereof.
Figure 19:
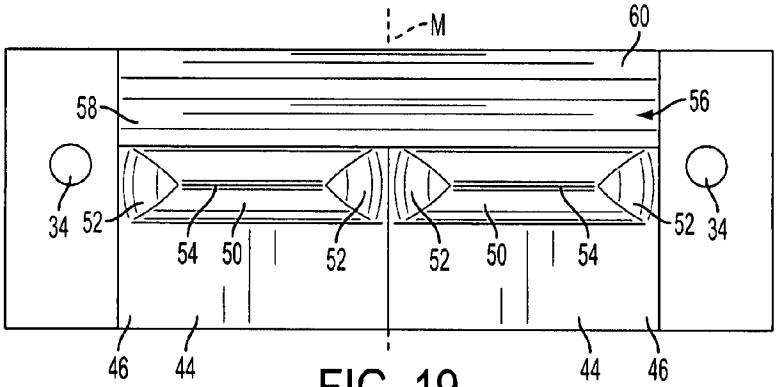
FIG. 19 is a front elevational view thereof.
Figure 20:
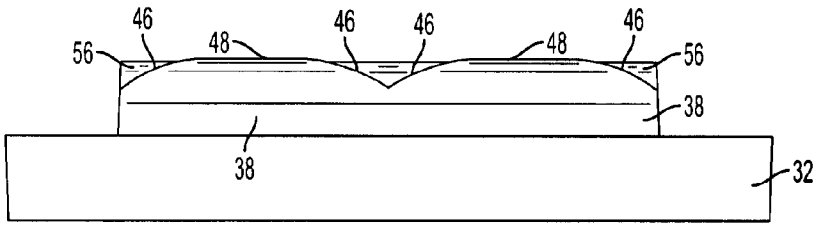
FIG. 20 is a bottom plan view thereof.
Figure 21:
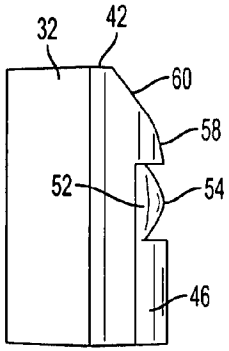
FIG. 21 is a right-side elevational view thereof.
Figure 22:
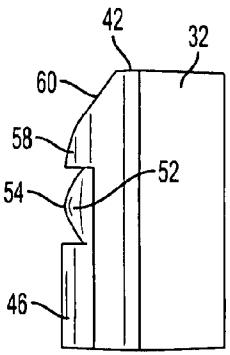
FIG. 22 is a left-side elevational view thereof.
Figure 24:
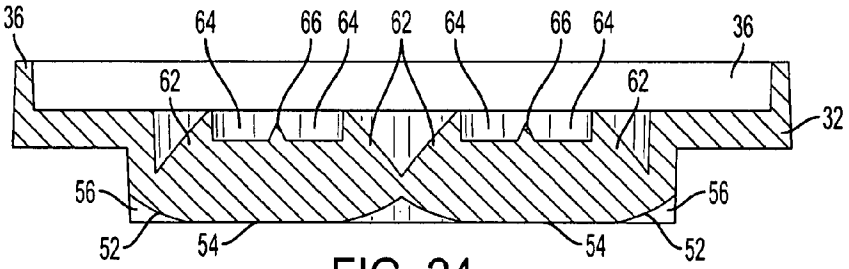
FIG. 24 is a cross-sectional view thereof taken along line 24-24 in FIG. 23.

The array of LED modules 8 shown in FIGS. 7 and 8 comprises a center row of six forward-facing modules flanked on each side by twelve modules (in two rows of six modules each) that face obliquely toward the center row. Other arrays of modules may be used to provide desired patterns of illumination. For example, U.S. Pat. No. 8,342,709 discloses five exemplary arrays of LED modules mounted to a luminaire carrier plate to produce the five different patterns shown in FIGS. 18-22 thereof. FIGS. 9-13 herein are substantial reproductions of those figures and show that the same types of patterns can be produced by arrays of modules 8 according to the present invention from a luminaire F projecting a light beam B generally along an optical axis X (the axis corresponding to the maximum candlepower). Those patterns substantially correspond to the beam shapes specified in IES NEMA regulations as Type I (FIG. 9); Type II (FIG. 10); Type III (FIG. 11); Type IV (FIG. 12); and Type V (FIG. 13). The module array of FIGS. 7 and 8 will produce a Type 3 beam shape.

Figure 27:
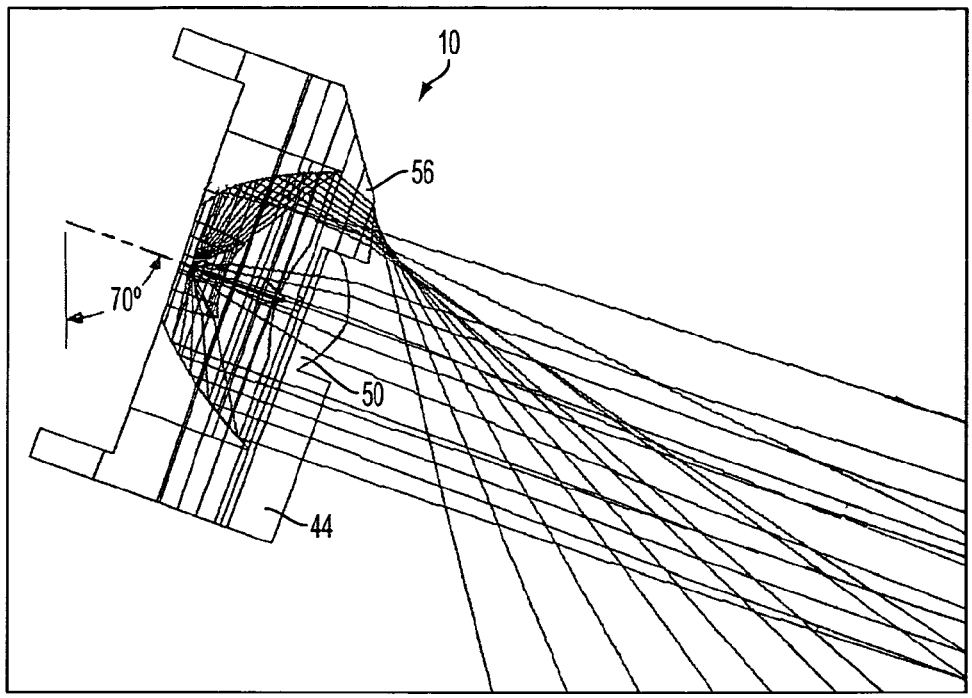
FIG. 27 is a left-side elevational view thereof showing LED light ray traces reflecting, refracting and emanating from the left half thereof.
Figure 28:
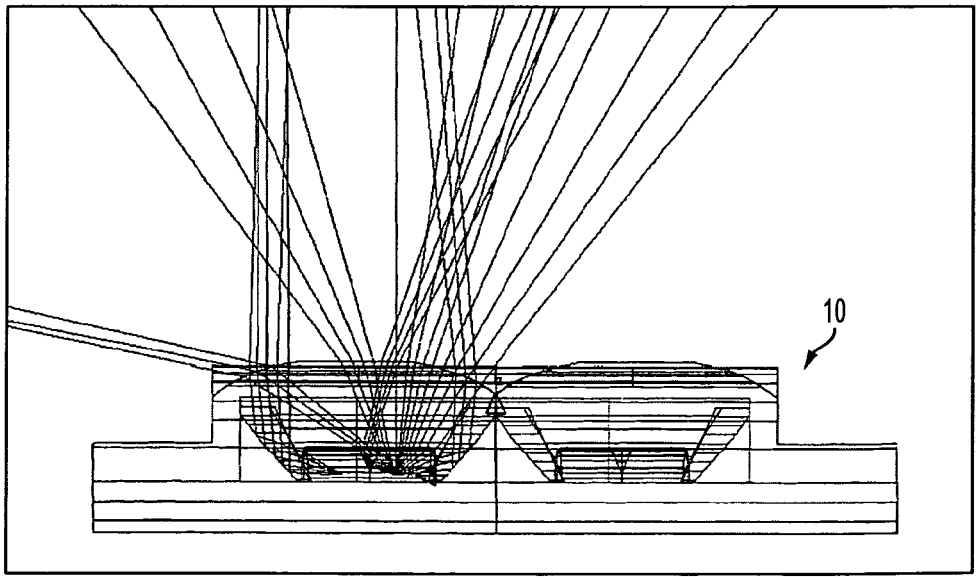
FIG. 28 is a top plan view thereof showing LED light ray traces reflecting, refracting and emanating from the right half thereof.

Due to the slant of heat sink top wall 29, prism 10 will face obliquely downward when the LED module is mounted to a substantially horizontal luminaire carrier plate. That orientation and the optical characteristics of the prism 10 (described below) will cause the optical axis X to meet a substantially horizontal surface to be illuminated at an angle of approximately 60° to 80° off vertical, preferably about 65° to 70° off vertical as shown in FIG. 27. This generally will be the situation regardless of luminaire mounting height. FIG. 1 of U.S. Pat. No. 8,342,709 schematically illustrates this geometry. As roughly illustrated by the ray traces in FIGS. 27 and 28 herein, about 95% of the main beam intensity will be within about a 10° to 12° vertical spread by about a 30° to 40° horizontal spread, and about 5% of the beam intensity will be aimed downward at about 20° to 25° off vertical to help fill dark spots below the luminaire. For the sake of simplicity, FIG. 28 shows the ray traces of only one side of prism 10. The ray traces of the other side of the prism are the mirror image of those shown, with beam overlap in the central region.

Figure 23:
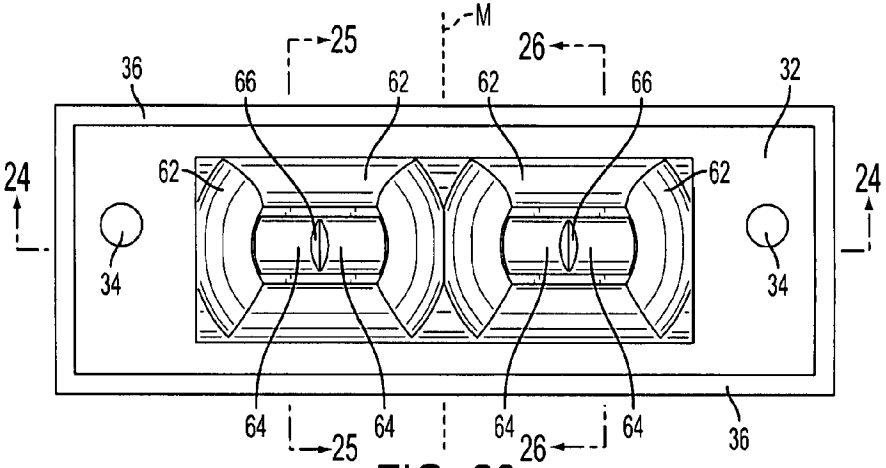
FIG. 23 is a rear elevational view thereof.
Figure 26:
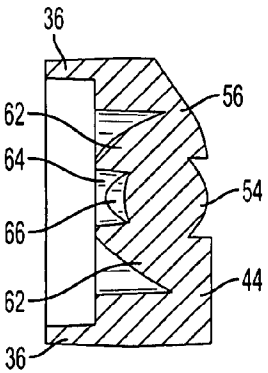
FIG. 26 is a cross-sectional view thereof taken along line 26-26 in FIG. 23.
Figure 25:
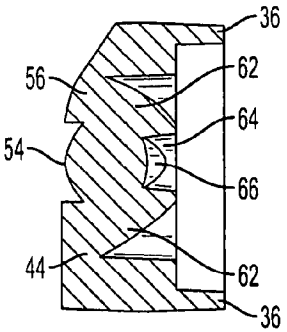
FIG. 25 is a cross-sectional view thereof taken along line 25-25 in FIG. 23.

Prism 10 preferably is molded of a UV stabilized, optically clear acrylic thermoplastic material having a refractive index of about 1.49. Other materials may be used instead, for example, glass or polycarbonate. The optical surfaces preferably have a class A polish to maximize internal reflections. FIGS. 14-28 show the physical features of the prism, which is bilaterally symmetrical about its fore-and-aft medial vertical plane M (see FIGS. 19 and 23) and includes a hollow rectangular mounting base 32 having mounting holes 34 and a peripheral flange 36 that surrounds PCB 16. The light-shaping portions of prism 10, which are integrally formed with base 32, are situated centrally and mostly forward of flange 36 and have a flat bottom 38, flat sides 40 and a flat top 42.

At the front of prism 10 on each side of the medial vertical plane, at the bottom, is a bulging "breakfront" portion 44 having curved vertical sides 46 and a substantially flat, vertical front face 48. Above breakfront portion 44 is a horizontal "semi-tubular" portion 50 with rounded ends 52 and a rounded face 54, which has a radius of curvature that tightens toward its horizontal center. Above semi-tubular portion 50 is a horizontal "forehead" bar 56 that spans both sides and has a slightly slanted "brow" portion 58, which gradually transitions to a flat, more slanted "crown" portion 60. At the rear of prism 10 on each side of the medial vertical plane is a convex, horizontally elongated "cradle" portion 62, which has two side-by-side pockets (recesses) 64 separated by a vertical rib 66. Each pocket 64 cradles an LED 18 (see FIGS. 2 and 3). As seen in FIG. 27, it is forehead bar 56 that directs the small portion (about 5%) of the beam intensity downward to help fill dark spots below the luminaire.

While exemplary embodiments have been chosen to illustrate the invention, it will be understood by those skilled in the art that various changes, modifications, additions, and substitutions are possible, without departing from the scope and spirit of the invention.

What is claimed is:

1. An LED lighting module for installation on the underside of a luminaire carrier plate comprising:
- a metallic heat sink including:
  - a front end having a front face,
  - a top wall extending rearward from said front end and having a top face for abutting the underside of the carrier plate, and
  - a plurality of cooling fins extending rearward from said front end and downward from said top wall;
- a circuit board mounted on said front face and carrying at least one LED; and
- a prism mounted to said heat sink over said at least one LED.

2. The lighting module of claim 1, wherein said heat sink is integrally formed as one piece.

3. The lighting module of claim 2, wherein said top face is disposed at an acute angle to said front face.

4. The lighting module of claim 2, wherein said top wall has at least one opening for accommodating a fastener for securing the module to a carrier plate.

5. The lighting module of claim 4, further comprising an upwardly projecting locating stud integral with said top wall for engaging a hole or a recess in the carrier plate.

6. The lighting module of claim 2, further comprising a sealing gasket between said prism and said front face and surrounding said circuit board.

7. The lighting module of claim 6, wherein said prism comprises a hollow mounting base having a flange surrounding said circuit board.

8. The lighting module of claim 2, wherein said cooling fins taper in height from said front end rearward.

9. The lighting module of claim 2, wherein said top wall is devoid of cooling fins above said top face.

10. The lighting module of claim 2, wherein said at least one LED comprises four aligned LEDs arranged in two laterally spaced pairs.

11. The lighting module of claim 10, wherein said prism comprises a rear face having four aligned pockets arranged in two laterally spaced pairs, each pocket cradling a respective LED.

12. A luminaire comprising a carrier plate and a plurality of lighting modules according to claim 2 mounted against the underside of the carrier plate.

13. A catadioptric prism for shaping and directing light emitted by an even number of aligned, laterally spaced LEDs having a transparent body with a fore-and-aft medial vertical plane and comprising:

a rear light-receiving face;

a front light-emitting face;

a top face;

a bottom face; and two side faces, said front face including:

a prominent lower section on each side of said medial vertical plane, each lower section having a substantially vertical front and substantially vertical curved sides and that merge with said front;

a prominent middle section above each lower section, the width of each middle section being greater than its height, each middle section having a substantially horizontal rounded face and rounded ends that merge with said rounded face; and a prominent upper section above both of said middle sections, said upper section having a downwardly and forwardly slanted surface, and said rear face including a convex cradle section on each side of said medial vertical plane, each cradle section having at least one pocket behind said middle section of said front face for cradling an LED, said pockets being symmetrically disposed on opposite sides of said medial vertical plane.

14. The catadioptric prism of claim 13, wherein the prism is bilaterally symmetrical about said medial vertical plane.

15. The catadioptric prism of claim 14, wherein said lower sections and said middle sections have substantially the same width.

16. The catadioptric prism of claim 15, wherein said lower sections meet at said medial vertical plane and extend laterally to their respective adjacent side faces, said middle sections meet at said medial vertical plane and extend laterally to their respective adjacent side faces, and said upper section extends completely to both of said side faces.

17. The catadioptric prism of claim 16, wherein the front of each of said lower sections is substantially flat.

18. The catadioptric prism of claim 17, wherein the radius of curvature of the rounded face of each of said middle sections diminishes toward the most prominent part thereof.

19. The catadioptric prism of claim 18, wherein said slanted surface of said upper section of said front face comprises a brow portion that is more steeply sloped than the portion above it.

20. The catadioptric prism of claim 19, wherein said at least one pocket comprises two laterally aligned pockets in each cradle section.

21. The catadioptric prism of claim 20, wherein said top face, said bottom face and said side faces are substantially flat.

22. The catadioptric prism of claim 21, further comprising an integral, substantially rectangular base having a rearwardly projecting peripheral flange for surrounding a printed circuit board on which the LEDs are mounted.

23. The catadioptric prism of claim 14, wherein said at least one pocket comprises two laterally aligned pockets in each cradle section.

24. The catadioptric prism of claim 23, wherein said slanted surface of said upper section of said front face comprises a brow portion that is more steeply sloped than the portion above it.

25. The catadioptric prism of claim 24, wherein during use said lower sections and said middle sections emit beam patterns that diverge laterally and overlap in a central region, and said upper section emits a primarily downwardly directed beam pattern.

* * * * *